US007235284B1

(12) United States Patent
Fryberg et al.

(10) Patent No.: US 7,235,284 B1
(45) Date of Patent: Jun. 26, 2007

(54) RECORDING SHEETS FOR INK JET PRINTING

(75) Inventors: Mario Fryberg, Praroman (CH); Stefan Schuttel, Murten (CH); Hiroshi Tomimasu, Monroe, NY (US)

(73) Assignee: Ilford Imaging Switzerland GmbH (CH)

( * ) Notice: Subject to any disclaimer, the term of this patent is extended or adjusted under 35 U.S.C. 154(b) by 0 days.

(21) Appl. No.: 09/040,825

(22) Filed: Mar. 18, 1998

(30) Foreign Application Priority Data

Mar. 20, 1997 (EP) ..... 97104740

(51) Int. Cl.
*B41M 5/00* (2006.01)

(52) U.S. Cl. ..... 428/32.28; 428/32.26; 428/32.27; 428/32.38; 428/500; 347/105

(58) Field of Classification Search ..... 428/500, 428/508, 511, 516, 513, 523, 474.4, 483, 428/32.28; 347/105; 162/135, 164.6, 168.2
See application file for complete search history.

(56) References Cited

U.S. PATENT DOCUMENTS

| | | | | |
|---|---|---|---|---|
| 2,240,472 A | | 4/1941 | Swan | 95/7 |
| 2,271,623 A | | 2/1942 | Carroll | 95/7 |
| 3,609,132 A | * | 9/1971 | Tsuk et al. | |
| 4,503,111 A | | 3/1985 | Jaeger et al. | 428/195 |
| 4,547,405 A | | 10/1985 | Bedell et al. | 427/256 |
| 4,554,181 A | | 11/1985 | Cousin et al. | 427/261 |
| 4,575,465 A | | 3/1986 | Viola | 427/261 |
| 4,592,951 A | | 6/1986 | Viola | 428/323 |
| 4,741,969 A | | 5/1988 | Hayama et al. | 428/514 |
| 4,783,376 A | | 11/1988 | Sakaki et al. | 428/511 |
| 4,801,497 A | | 1/1989 | Kono et al. | 428/332 |
| 4,877,680 A | | 10/1989 | Sakaki et al. | 428/332 |
| 4,892,787 A | | 1/1990 | Kruse et al. | 428/331 |
| 4,904,519 A | | 2/1990 | Newman | 428/203 |
| 4,944,988 A | | 7/1990 | Yasuda et al. | 428/195 |
| 4,956,230 A | | 9/1990 | Edwards et al. | 428/341 |
| 5,132,146 A | | 7/1992 | Maruyama et al. | 427/261 |
| 5,180,624 A | | 1/1993 | Kojima et al. | 428/211 |
| 5,270,103 A | | 12/1993 | Oliver et al. | 428/219 |
| 5,281,307 A | * | 1/1994 | Smigo et al. | 162/164.3 |
| 5,300,566 A | * | 4/1994 | Pinschmidt, Jr. et al. | 525/60 |
| 5,352,503 A | | 10/1994 | Drake et al. | 428/195 |
| 5,620,793 A | * | 4/1997 | Suzuki et al. | 428/342 |
| 5,747,146 A | * | 5/1998 | Kashiwazaki et al. | 428/206 |
| 5,910,359 A | * | 6/1999 | Kobayashi et al. | 428/327 |

FOREIGN PATENT DOCUMENTS

| | | | |
|---|---|---|---|
| DE | 19505295 | | 9/1995 |
| EP | 0 046416 | | 2/1982 |
| EP | 0423829 | A1 | 4/1991 |
| EP | 0 445 327 | A1 * | 9/1991 |
| EP | 0559324 | A1 | 9/1993 |
| EP | 0 617166 | A1 | 9/1994 |
| EP | 0631880 | A1 | 1/1995 |
| EP | 0631881 | A1 | 1/1995 |
| EP | 0634289 | A1 | 1/1995 |
| EP | 0650850 | A2 | 5/1995 |
| GB | 2147003 | A | 5/1985 |
| JP | 01 008 085 | | 1/1989 |
| JP | 04201594 | | 7/1992 |
| JP | 04263984 | | 9/1992 |
| WO | WO 94/26530 | | 11/1994 |

OTHER PUBLICATIONS

Hughes et al., Macromolecular Synthesis 6, 31-37 (1977).
Titterington et al., Journal of Imaging Science, 30(1) ; No. 1, Jan./Feb. pp. 4-8 (1986).
Analytical Report, Photographic Gelatin ST 71, 810 Deutsche Gelatinefabrikin (DGF Stoess) (1995).
Olin Chemical Specialties Specifications—Glycidol Surfactant 10G, Olin Corporation (1989).

* cited by examiner

*Primary Examiner*—Marie Yamnitzky
(74) *Attorney, Agent, or Firm*—Onofrio Law; Dara L. Onofrio, Esq.

(57) ABSTRACT

There is described a recording sheet for ink jet printing comprising a polyethylene coated paper support having coated onto the front side of said support one ink receiving layer comprising a mixture of gelatin and rice starch.

15 Claims, No Drawings

RECORDING SHEETS FOR INK JET PRINTING

FIELD OF THE INVENTION

This invention relates to recording sheets suitable for use in an ink jet recording process. In particular it relates to ink receiving sheets where images recorded thereon can be observed by both reflected and transmitted light, where the ink receiving system consists of a support onto which are coated one or more layers and where at least one of these layers contains at least one polymeric mordant.

BACKGROUND OF THE INVENTION

Ink jet receiving materials used at the present time have a particular need for improvement in physical and handling properties, particularly in light fastness and water fastness together with an improved image quality. A preferred embodiment of this invention is therefore directed towards ink jet recording materials with improved handling and performance characteristics. In particular ink receiving materials are sought where the images recorded thereon are resistant to rubbing of the surface or to damage by other physical means, Moreover printed images should remain intact when in contact with water and particularly should not fade when exposed to light even under adverse conditions. The present invention provides a solution towards these problems.

Ink jet printing systems generally are of two types: continuous stream and drop on demand. In continuous stream ink jet systems, ink is emitted in a continuous stream under pressure through at least one orifice or nozzle. The stream is perturbed, causing it to brake up into droplets at a fixed distance from the orifice. At the break up point, the droplets are charged in accordance with digital data signals and passed trough an electric static field which adjusts the trajectory of each droplet in order to direct it to a specific location on a recording medium or a gutter for recirculation. In drop on demand systems, a droplet is expelled from an orifice directly to a position on a recording medium in accordance with digital data signals. A droplet is not formed or expelled unless it is to be placed on the recording medium.

This invention is directed towards both methods, the more demanding continuous stream system as well as towards the more common drop on demand printing devices.

It is known that images created with a state of the art ink jet printer must meet a number of stringent demands. The following requirements are some of the features recording materials used in ink jet printing systems must necessarily fulfil in order to yield printed images of high quality:

1. Sufficient ink absorbing capacity and ink receptivity of the receiving layer to prevent the ink from streaking and from running down during printing, even under conditions where several droplets are deposited in a rapid sequence onto the same spot.
2. Fast drying of the layer surface after printing of the image leading to prints free from tackiness.
3. Excellent colour rendition, no change of hue of the picture with time.
4. Surface with high gloss.
5. In the case of transparencies, the printed images must be clear, transparent and scatter free.
6. Resistance of the image surface to rubbing.
7. Excellent water fastness of the printed images.
8. Excellent light fastness of the printed images.

9. Excellent archival stability of the printed images.
10. Excellent physical and handling properties before and after printing.

The particular problem of water fastness has in the past been addressed by a wide variety of techniques. Thus solutions to the problem have been proposed by using specific formulations of the inks or alternatively in many cases by specific modifications of the receiving layers. The two approaches have occasionally been combined.

Solutions aimed at resolving the problems of ink absorbing capacity, drying time and image quality have in many instances been attempted by specific modification of the composition of the coated receiving systems. A widely used approach to control absorbtivity and to a certain extent dot spread is through incorporation of high molecular weight hydrophilic polymeric substances.

Particularly favoured in this respect are polyvinyl alcohol and polyvinyl pyrrolidone. U.S. Pat. No. 4,503,111 describes ink receiving layers where for instance gelatine, polyvinyl alcohol and polyvinyl pyrrolidone are mixed. This combination is claimed to allow the printing of large colour filled areas with high colour density without generating puddling and ink running. U.S. Pat. No. 4,592,951 describes layers of crosslinked polyvinyl alcohol aimed at solving the same problems. Additional examples of patents claiming solutions to the above mentioned or similar problems involving layers containing polyvinyl alcohol alone or together with additional hydrophilic polymers are U.S. Pat. Nos. 4,741,969, 4,892,787, 5,132,146 and 5,352,503 as well as EP Patent Applications 0,631,880 and 0,650,850. Most attempts to achieve high water fastness in receiving layers have been through the use of cationic polymers in conjunction with inks containing acidic dyes. Polyvinyl alcohol and cationic compounds are often used simultaneously. This approach has been described extensively in the prior art. The following are some selected typical examples: U.S. Pat. No. 4,877,680 describes cationic polymers together with neutral binders. Cationically modified polyvinyl alcohol has been described in U.S. Pat. No. 4,783,376. U.S. Pat. No. 4,575,465 claims the use of quaternised polyvinyl pyridine to achieve water fastness. U.S. Pat. No. 4,554,181 describes the use of a combination of cationic polymers and polyvalent metal salts since only such combinations and not the single elements are claimed to provide the sought after properties. U.S. Pat. No. 5,180,624 and EP Patent Application 0,634,289 again combine hydrophilic binders like for instance gelatine or polyvinyl alcohol with cationic substances like for instance quaternised polyvinyl pyridine or poly(meth)acryl quaternary salts for high optical density and uniform image definition. Further patents describing similar approaches are U.S. Pat. Nos. 4,801,497 and 5,270,103.

EP Patent Application 0,423,829 describes the combination of silica particles with polyvinyl alcohol and cationic water soluble acrylic polymers. Layers with good ink absorption and good image quality were obtained. The light fastness of the printed image does however not seem to satisfy today's demands. A similar approach using colloidal silica and a modified polyvinyl amine is described in WO Patent Application 94/26,530. Similarly EP Patent Application 0,423,829 claims polyvinyl alcohol and a cationic acrylic copolymer carrying at least two cationic radicals in the side chain as a solution to achieve water fastness of the printed image.

In JP Patent Application 01-008,085 cationic copolymers containing more than 30% amine groups were coated onto wood free paper base together with polyvinyl alcohol and finely powdered silica. The layers were subsequently heated to 120° C. The image is claimed to have good water fastness and light fastness. A similar approach has been taken in JP Patent Application 04-263,984. Polyvinyl alcohol groups taken together with primary or secondary amines or the corresponding ammonium salts are coated together with dialdehydes. This approach is less suitable for the preparation of permanent images due to the tendency of prints on such layers to yellow on ageing. EP Patent Application 0,631,881 describes mixtures of polyvinyl alcohol, polyvinyl pyrrolidone, vinyl acetate and poly (dimethyl-diallyl) cationic polymers aimed at achieving good water fastness.

A further approach aimed at improving ink receiving materials has been the use of vinyl based copolymers. U.S. Pat. No. 4,547,405 describes the preparation of receiving sheets containing a coalesced block copolymer latex of polyvinyl alcohol with polyvinyl (benzyl ammonium) chloride. U.S. Pat. No. 4,904,519 claims the preparation of an ink receptive layer comprising hydrolysed copolymers formed from 70 to 30% of vinyl amide monomers and vinyl ester monomers. Crosslinking is achieved with borates or other similarly acting salts and with aldehydes. The layers are claimed to accept ink readily and to be resistant to fingerprinting. The degree of hydrolysis has, as described in the patent, to be kept under tight control. If the amide part of the copolymer is even partially hydrolysed the resulting layers tend to remain tacky after printing. A similar approach has been taken in U.S. Pat. No. 4,944,988. Copolymers prepared from for instance vinyl acetate together with cationic tertiary amino radical containing acrylic monomers are used to prepare receiving layers without hydrolysing the esters. Polymers of this kind, although described to be beneficial towards improving image quality, have unfortunately due to their low basicity only low activity as mordants for inks based on anionic dyes. They do therefore influence only marginally the water fastness of the printed images.

U.S. Pat. No. 4,956,230 describes a blend of hydrophilic and hydrophobic polymers or copolymers free of OH, NH and $NH_2$ groups. The major advantages of such polymers or copolymers are claimed to be good image quality, resistance to layer softening at high humidity and fast drying. No appreciable mordant activity can however be expected from such compounds.

Although improved water fastness can in many instances be obtained with a variety of such cationic elements, these systems on the other hand tend to show a severe drawback in that they seriously impair the light fastness of the printed images. Moreover such systems often tend to show poor water fastness despite the fact that such cationic polymers bind anionic or acid dyes quite efficiently This is often due to the fact that the layers as a whole disintegrate in water. This may also be due to poor adhesion of the layers to the support. This is particularly the case with photolike bases like polyolefin coated papers or polyester films.

Cationic polymeric substances have also been combined with metal salts, for instance in JP Patent Application 4,201,594 and in GB Patent 2,147,003. The major benefit of adding such metal salts seems to be an improved light fastness of the produced images.

An additional problem observed in many cases is irregular imaging density due to poor ink receiving properties of the receiving sheets. This may occur for different reasons. Among others it may be due to the uncontrolled binding of the dyes on the surface due to a particular mordant system. Another reason may be the poor wetting of the layer surface by the ink due to a particular cationic polymer. Layers with rapid ink uptake seem to be a prerequisite for good image quality. EP Patent Application 0,445,327 describes receiving layers with good image quality on polyolefin coated paper. The receiving layers consist of a mixture of gelatine and starch powder. Excellent image quality is described for layers containing hydrophilic polymers or mixtures of polymers like gelatine with polyvinyl alcohol or polyvinyl pyrrolidone when used together with water based inks (Journal of Imaging Science 30, 4, 1986). Gelatine has also been combined with cationic polymers, in particular with quaternised polyvinyl pyridine, and has been claimed to give reasonably good images in U.S. Pat. No. 4,575,465. Quaternised pyridinium compounds are however notorious in inducing poor light fastness of the acidic dyes usually used in ink jet printing.

In practically all cases known in the art where water fastness is desired it is achieved by making use of the mordanting effect of cationic species based on tertiary amino radicals. Although good water fastness is achieved in many cases, improvement of light fastness in particular is in general neither observed nor claimed.

The ideal combination of mordants, binders and crosslinking agents leading to printed images combining good water fastness, image quality, archival stability together with excellent light fastness is still lacking.

SUMMARY OF THE INVENTION

Accordingly an object of the present invention is to provide image receiving sheets for use in ink jet recording which are particularly excellent in light fastness and improved in water fastness.

A further objective is to obtain recording sheets with excellent surface properties showing high resistance to physical damage like for instance scratching, resistance to cracking and moist rubbing on the surface. Still an other objective of the present invention is to provide receiving sheets with excellent ink receiving properties with a variety of ink jet printers available on the market today.

Another objective of the invention is to obtain recording sheets which satisfy in sharpness and surface lustre of the recorded images and are free from stickiness of the surface even under highly humid conditions.

A further object is to provide receiving sheets which allow the possibility to print images which in terms of archival stability and light fastness tend to match those of silver halide based photographic materials.

It is furthermore an objective of this invention to provide clear, scatter free recorded images on transparent base materials intended to be projected.

The invention proposes to achieve these objectives by providing particularly light fast recording sheets consisting of an opaque or transparent support onto which are coated one or more ink receiving layers. These receiving layers contain at least one copolymeric substance containing primary or secondary amino groups and vinyl ester derived hydroxy groups. The copolymers used in the present invention have the following general structure:

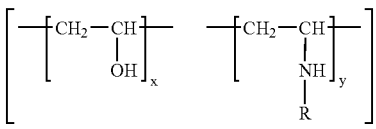

where

R is H or alkyl with 1–6 carbon atoms x+y=1, y=0.05–0.2, x=0.8–0.95.

In addition to the copolymer the ink receiving layers may contain another binder or a mixture of binders. Furthermore the layers may contain a crosslinking agent capable of crosslinking the copolymer or the copolymer and the other binders. Additionally the layers may contain fillers, natural or synthetic polymers and diverse other additives known in the art to further improve the pictorial and/or physical quality of the printed images for example UV absorbers, optical brightening agents, light stabilisers, antioxidants, humefactants, spacing agents and the like.

These and other objects of the invention will become more readily apparent to those skilled in the art in the following detailed description.

DETAILED DESCRIPTION OF THE INVENTION

The invention describes the use of copolymers of the following general structure in receiving sheets for ink jet printing

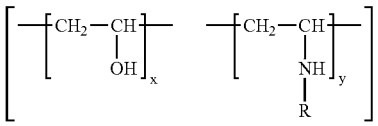

where

R is H or alkyl with 1–6 carbon atoms, x+y=1, y=0.05–0.2, x=0.8–0.95.

Monomers leading to the unit containing OH groups are for instance vinyl esters as for example vinyl propionate, and the like.

Monomers leading to the unit containing NHR groups are vinyl amides like for instance N-vinyl-formamide, N-vinyl-acetamide, N-vinyl-propionamide, N-methyl-N-vinyl-formamide, N-methyl-N-vinyl-acetamide and the like.

Preferred copolymers of the invention have the structure

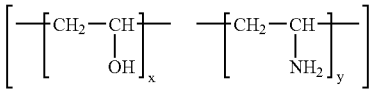

where x+y=1, y=0.05–0.2, x=0.8–0.95.

Preferred copolymers of the invention have a molecular weight from 20,000 to 150,000.

The claimed copolymeric compounds perform most efficiently when they are imbedded into layers with the ability of rapidly absorbing aqueous inks. The compounds that make up the imbedding matrix include in general water soluble polymers. In a most preferred embodiment of the invention the copolymer on its own or in the mixture with the other binders is film forming.

These water soluble polymers may include for example natural polymers or modified products thereof such as albumin, gelatine, casein, starch, gum arabic, sodium alginate, hydroxyethyl cellulose, carboxymethyl cellulose, α- β- or γ-cyclodextrine and the like. In the case where one of the water soluble polymers is gelatine the types of gelatine suitable for use in the present invention include all kinds of gelatine currently known, for instance acid pigskin or limed bone gelatine, acid or base hydrolysed gelatines, but also derivatised gelatines like for instance phthaloylated, acetylated or carbamoylated gelatine or gelatine derivatised with trimellitic acid. The preferred gelatine is a gelatine with a high isoelectric point between 7 and 9.5.

Useful synthetic polymers are for instance polyvinyl alcohol; completely or partially saponified products of copolymers of vinyl acetate and other monomers; homopolymers of or copolymers with monomers of unsaturated carboxylic acids such as (meth)acrylic acid, maleic acid, crotonic acid and the like; homopolymers of or copolymers with vinyl monomers of sulfonated vinyl monomers such as vinylsulfonic acid, sulfonated styrene and the like. Furthermore can be used homopolymers of or copolymers with vinyl monomers of (meth)acrylamide; homopolymers or copolymers with other monomers of ethylene oxide; polyurethanes; polyacrylamides; water soluble nylon type polymers; polyvinyl pyrrolidone; polyesters, polyvinyl lactams; acrylamide polymers; polyvinyl alcohol and its derivatives; polyvinyl acetals; polymers of alkyl- and sulfoalkyl acrylates and methacrylates; hydrolysed polyvinyl acetates; polyamides; polyvinyl pyridines; polyacrylic acid; maleic anhydride copolymers; polyalkylene oxides; methacrylamide copolymers and maleic acid copolymers; All these polymers can also be used as mixtures.

These polymers can be blended with non water soluble natural or synthetic high molecular compounds, particularly with acrylate latices or with styrene acrylate latices.

Although not specifically claimed in this invention non water soluble polymers should nevertheless be considered part of the system.

The polymers mentioned above having reactive groups or groups having the possibility to react with a crosslinking agent can be crosslinked to form essentially non water soluble layers. Such crosslinking bonds may be either covalent or ionic. Crosslinking allows for the modification of the physical properties of the layers, like for instance in water absorbency of the layer, but also in resistance against physical damage.

The crosslinking agents are selected depending on the water soluble polymer used. They can include for example aldehydes (such as formaldehyde, glyoxal or glutaraldehyde), N-methylol compounds (such as dimethylol urea or methylol-dimethylhydantoin), dioxane derivatives (such as 2,3-dihydroxy dioxane), active vinyl compounds (such as 1,3,5-triacrylolyl hexahydro-s-triazine or bis-(vinylsulfonyl) methyl ether), active halogen compounds (such 2,4-dichloro-6-hydroxy-s-triazine), epoxydes, aziridines, carbamoyl pyridinium compounds or mixtures of two or more of the above mentioned crosslinking agents. Preferentially crosslinking agents are used which are capable to react with groups of the claimed copolymer as well as with the matrix forming binders.

The layers can be modified by the addition of fillers. Possible fillers are for instance kaolin, talcum, Ca- or Ba-carbonates, silica, titanium oxide, chalk, bentonite, zeolite, aluminium silicate, calcium silicate, silicium oxide, colloidal silicium oxide and the like. Likewise the possibility exists to use organic inert particles such as polymer beads. This includes beads made from polyacrylates, polyacrylamides, polystyrene or different copolymers of acrylates and styrene. These fillers are selected according to the intended use of the printed image. Some of these compounds cannot be used if the printed image is to be used as a transparency. Alternatively they are of interest in cases where the printed image is be to used as a remission picture. Often the introduction of such filler causes a wanted matte surface.

In addition to the above mentioned elements layers containing the copolymers of the invention may also contain water soluble metal salts like for instance the salts of Ca, Ba, Mg, or the salts of the rare earth metal series.

The image recording sheets of the invention comprise a support for the ink receiving layer. A wide variety of such supports are known and commonly employed in the art. They include, for example, those supports used in the manufacture of photographic clear films including cellulose esters such as cellulose triacetate, cellulose acetate, cellulose propionate or cellulose acetate butyrate, polyesters such as poly(ethylene terephthalate), polyamides, polycarbonates, polyimides, polyolefins, poly(vinyl acetals), polyethers, polyvinyl chloride and polysulfonamides. Polyester film supports, and especially poly(ethylene terephthalate) are preferred because of their excellent dimensional stability characteristics.

Likewise the usual supports commonly used in the manufacturing of opaque photographic material can be used according to the present invention. They include baryta paper, polyethylene coated paper, polypropylene synthetic paper, voided polyester as for instance manufactured by ICI under the trade name of MELINEX as well as voided polypropylene likewise manufactured by the same company. Preferred are clear polyester, voided polyester or resin coated paper.

When such support material, in particular polyester, is used a subbing layer is advantageously added first to improve the bonding of the ink receiving layers to the support. Useful subbing compositions for this purpose are well known in the photographic art and include, for example, polymers of vinylidene chloride such as vinylidene chloride, acrylonitrile acrylic acid terpolymers or vinylidene chloride/methyl acrylate/itaconic acid terpolymers.

Also used as supports are plain paper, comprising all different types of papers varying widely in their composition and in their type of sizing. Further can be used pigmented papers and cast coated papers. Possible are also metal foils as for instance foils made from alumina.

The ink receiving layers according to this invention are in general coated from aqueous solutions or dispersions containing binders, additives, pigments and the like. It is in many cases necessary to add surfactants to those coating solutions or dispersions allowing for smooth coating and evenness of the layers. Examples of suitable surfactants are nonionic surface active agents such as saponin, alkylene oxide derivatives (such as polyethylene glycol, polyethylene glycol/polypropylene glycol condensates, polyethylene glycol alkyl or alkylaryl ethers, polyethylene glycol esters, polyethylene glycol sorbitol esters, polyalkylene glycol alkylamine or amides or silicone/polyethylene oxide adducts), glycidol derivatives (such as alkenylsuccinic acid polyglycerides or alkylphenol polyglycerides), aliphatic esters of polyhydric alcohols, alkyl esters of sucrose, urethanes or ethers; a sulphuric acid ester group or a phosphoric acid ester group, such as triterpenoid type saponin, alkylcarboxylates, alkylsulfonates, alkylbenzenesulfonates, alkylnaphthalenesulfonates, alkyl sulphuric acid esters, alkyl phosphoric acid esters, N-acyl-N-alkyltaurines, sulfosuccinates, sulfoalkylpolyoxyethylene, alkyl phenyl ethers or polyoxyethylene alkyl phosphates and cationic surface active agents such as alkylamine salts, aliphatic or aromatic quaternary ammonium salts (such as pyridinium or imidazolium salts) or phosphonium or sulphonium salts containing an aliphatic or heterocyclic ring.

Equally suitable are fluorinated or perfluorinated derivatives of the above mentioned compounds.

Specific examples of these surface active agents are those described in, e.g., U.S. Pat. Nos. 2,240,472, 2,271,623, 2,288,226, 2,739,891, 2,823,123, 2,831,766, 2,944,900, 3,068,101, 3,133,816, 3,158,484, 3,210,191, 3,253,919, 3,294,540, 3,415,649, 3,441,413, 3,475,174, 3,507,660, 3,545,974, 3,589,906, 3,666,478, 3,671,247, 3,726,683, 3,754,924, 3,756,828, 3,772,021 and 3,843,368; GB Patents 1,012,495, 1,022,878, 1,138,514, 1,159,825, 1,179,290, 1,198,450, 1,374,780 and 1,397,218, and BE Patent 731, 126.

Besides being necessary for coating purposes surfactants may have an influence on the quality of the generated images and may therefore be selected with this specific goal in mind. There is in general no limitation to the use of the types of surfactants used as long as they do no interfere with the printing inks used for the production of the images. Although not specifically claimed in this invention surfactants nevertheless form an important part of the invention.

Typically the receiving layers according to this invention have a thickness in the range of 0.5 to 30 micrometers, preferably in the range of 2 to 15 micrometers dry thickness.

The coating solutions or coating dispersions can be coated onto a support by any number of suitable procedures. Usual coating methods include immersion or dip coating, roll coating, air knife coating, extrusion coating, doctor blade coating, cascade coating, curtain coating or spraying. An ink receiving system can be built up by several layers. These layers can be coated one after the other or simultaneously. It is likewise possible to coat a support on both sides with ink receiving layers. Alternatively the backside may be coated with auxiliary layers like for instance anticurl layers or antistatic layers. The method however by which the claimed ink receiving layers are produced is not to be considered limiting for the present invention.

In addition to the above mentioned elements ink receiving sheets as claimed in this invention may contain additional additives aimed at improving the appearance as well as the performance of the produced imaging material. It can for instance be beneficial to add brightening agents to the layers of the receiving sheets. There is in general no limitation as to the kind of brighteners used. Suitable brightening agents are for instance stilbenes, coumarines, triazines or oxazoles or others known in the art.

Light fastness can in some cases still be improved by adding UV absorbers to the layers. Although UV absorbers are in general added to the topmost layer of the system there is no limitation as to where within the ink receiving sheets such light absorbing compounds are added. The amount of UV absorber can vary from 200–2000 mg/m$^2$, preferably however from 400–1000 mg/m$^2$. Suitable types of UV absorbers can be benzotriazoles, benzophenones, derivatives of acrylonitrile, thiazolidones, oxazoles, thiazoles and others.

It is further known that images can be protected from degradation by the addition of light stabilisers and antioxidants. Examples of such compounds are among others sterically hindered phenols, sterically hindered amines, chromanols and the like. The above mentioned additives can, if water soluble, be added as aqueous solutions to the coating solutions. In the case where these compounds are not water soluble they can be incorporated into the coating solutions by common techniques known in the art. The compounds are typically dissolved in a solvent selected from organic solvents compatible with water, such as alcohols, glycols, ketones, esters, amides and the like. Alternatively the compounds can be added to the coating solutions as fine dispersions, as oil emulsions, as cyclodextrine inclusion complexes or incorporated into latex particles. Ultrasound or milling can be used to dissolve or disperse marginally soluble additives.

Inks for ink jet printing are well known. These inks consist in essence of a liquid vehicle and a dye or pigment dissolved or suspended therein. The liquid vehicle of the inks employed for the printing consists in general of water or a mixture of water and a water miscible organic compound such as ethylene glycol, higher molecular weight glycols, glycerol, dipropylene glycol, polyethylene glycol, amides, polyvinyl pyrrolidone, N-methylpyrrolidone, cyclohexylpyrrolidone, carboxylic acids and esters, ethers, alcohols, organosulfoxides, sulfolane, dimethylformamide, dimethylsulfoxide, cellosolve, polyurethanes, acrylates and the like.

The non water part of the ink generally serves as humefactant, co-solvent, viscosity regulating agent, ink penetration additive, levelling agent or drying agent. The organic component has in most cases a boiling point which is higher than that of water. In addition aqueous inks used for printers of the continuous flow type may contain inorganic or organic salts to impart electrical conductivity. Examples of such salts include nitrates, chlorides, phosphates and the like and salts of water soluble organic acids like acetates, oxalates and the like. The dyes and pigments suitable for the preparation of inks useable with the receiving sheets of the invention cover practically all classes of known colouring compounds. The ink receiving sheets according to this invention are therefore meant to be used in conjunction with most of the inks representing the state of the art. Dyes or pigments typically used for this purpose are described in EP Patent Application 0,559,324.

Other additives present in useable inks are for instance surfactants, optical brighteners, UV absorbers or light stabilisers, biocides and polymeric additives. This description of the inks is for illustration only and is not to be considered as limiting for the purpose of the invention.

The following test procedures were used to evaluate and compare the ink receiving sheets described in the present invention.

Water Fastness

Test sheets prepared according to the examples described below are printed either with a continuous type ink jet printer IRIS model 3024 or with a commercial drop on demand thermal ink jet printer as indicated. 1 cm by 1 cm uniform patches are printed in cyan (C), magenta (M), yellow (Y) and black (1K) to a density of about 2. After printing and drying under ambient conditions for 12 hours the densities of the individual patches are measured with an X-rite® densitometer. The samples are then placed in deionised water at 20° C. for the time indicated, removed from the water, allowed to drip dry and remeasured. The difference between the densitometer readings before and after washing is recorded as % loss of optical density.

Light Fastness

Printed sample sheets prepared as described above are measured on the X-rite® densitometer and exposed in an Atlas Weather-Ometer® with a 2500 W-Xenon lamp under conditions analogue to those set forth in ISO norm 10,977. The samples are exposed to a total illumination of 20 or 40 kJ/cm$^2$. The results are reported as % loss of density as determined by the difference of the readings before and after exposure.

Drop Test

A printed patch of density 2 prepared as described above is fixed on a board at an inclination of 45. Then several drops of deionised water are dropped onto the layer. The intensity of the rundown trace is evaluated by eye and rated from 0 (excellent) to 3 (bad).

Preparation of Copolymers According to the Invention

The copolymers according to the invention are either commercially available or can be prepared according to techniques known in the art. The preparation is exemplified in the following examples 1 and 2. These examples are for illustration only and are not to be considered in any way limiting the scope of the invention.

The copolymers are characterised by their physical properties, their molecular weight and by their amine/hydroxyl ratio as can be seen in the individual examples.

EXAMPLE 1

Preparation of polyvinyl alcohol-co-vinylamine copolymer 1 with 14% vinylamine content by polymerisation of the monomers vinyl acetate and N-vinyltert.-butylcarbamate (prepared by the method of A. R. Hughes, T. S. Pierre, Macromolecular Syntheses 6, 31 (1977)), followed by acidic hydrolysis:

Vinyl acetate (10.3 g, 120 mmol) and N-vinyl-tert.-butylcarbamate (2.8 g, 20 mmol) were dissolved in 10 ml of hexane in a 100 ml flask equipped with a mechanical stirrer, nitrogen inlet and condenser. The solution was purged with nitrogen during one hour. 100 mg (0.6 mmol) of azoisobutyronitrile was added and the polymerisation reaction was started by heating to reflux. After heating for 4 hours the reaction was stopped and the precipitated polymer was separated by filtration. Redissolving in toluene and precipitation with hexane yielded 7.7 g polyvinylacetate-co-vinyl-tert.-butylcarbamate polymer.

The polymer was redissolved in 200 ml of ethanol. 25 ml concentrated hydrochloric acid was added dropwise. The tert.-butylcarbamate groups hydrolysed spontaneously. Complete hydrolysis of the vinylacetate groups was achieved after 24 hours at room temperature. The copolymer 1 was first separated by filtration, then dissolved in 200 ml of water and reprecipitated by adding 300 ml of acetone. The yield was 3.4 g, molecular weight 37,000.

Similarly the following copolymers of Table 1 were prepared:

TABLE 1

| | Vinylamine content | Molecular weight |
|---|---|---|
| Copolymer 2 | 11% | 70'000 |
| Copolymer 3 | 12% | 70'000 |
| Copolymer 4 | 18% | 70'000 |
| Copolymer 5 | 6% | 70'000 |
| Copolymer 6 | 6% | 110'000 |

The copolymers 2 to 6 are also available from Air Products & Chemicals, Inc., Allentown, USA.

EXAMPLE 2

Preparation of polyvinyl alcohol-co-vinylmethylamine copolymer 7 with 16% vinylmethylamine content by polymerisation of the monomers vinyl acetate and N-methyl-N-vinylacetamide, followed by acidic hydrolysis:

Vinyl acetate (36.0 g, 420 mmol) and N-methyl-N-vinylacetamide (8.0 g, 80 mmol) were dissolved in 50 ml tert.-butanol in a 250 ml flask, equipped with a mechanical stirrer, nitrogen inlet and condenser. The solution was purged with nitrogen during one hour. 200 mg (1.2 mmol) of azoisobutyronitrile was added and the polymerisation reaction was started by heating to 70° C. After heating for 24 hours the reaction was stopped and the solvent was removed by distillation under reduced pressure.

The polymer was redissolved in 100 ml of ethanol. 100 ml 15% hydrochloric acid was added dropwise. Complete hydrolysis of the vinylacetate and acetamide groups was achieved after 24 hours at 100° C. To separate from low molecular weight impurities, the solution was dialysed after neutralisation (size exclusion limit: 12,000). Yield of copolymer 7 after dialysis was 10.0 g of molecular weight 40,000.

Preparation of Coating Solutions

Coating solutions used in the following examples were in general prepared according to the following procedure. If different procedures were used they are mentioned in the examples concerned.

100 g of gelatine (Type ST 71'810 with high isoelectric point, available from Deutsche Gelatinefabriken, Eberbach, Germany, unless indicated otherwise) were dissolved in 850 ml of deionised water at 40° C. To this solution a 1% solution of surfactant in water was added. Olin 10G, available from Olin Corporation, Norwalk, USA, was used unless indicated otherwise. Then a solution of the appropriate copolymer in water was added. Additional binders, salts or fillers were added if appropriate and the pH adjusted to the desired value by adding dilute sulphuric acid. The total solid content of the coating-solution was adjusted by additional deionised water to be in the range of 6–10 g/liter. The required amount of hardener (crosslinking agent) in water was added to this solution just prior to the coating operation. The hardener used was a 3% solution in water of 2-(4 dimethyl-carbamoyl-pyridino)ethane sulfonate.

The prepared coating solutions were in general coated onto clear polyester film or then onto any other required support as mentioned in the following examples. The layers obtained are outlined in more detail by their composition given in g/m$^2$.

EXAMPLE 3

The samples listed in Table 2 on clear polyester film were prepared as described above. A standard limed bone gelatine, obtained from Deutsche Gelatinefabriken, Eberbach, Germany, was used. The pH of the coating solutions was adjusted to 6.0.

TABLE 2

| Sample No | 1 | 2 | 3 | 4 |
|---|---|---|---|---|
| Gelatine (g/m$^2$) | 4.5 | 4.5 | 4.5 | 4.5 |
| Copolymer 3 (g/m$^2$) | — | 3.0 | — | — |
| Copolymer 5 (g/m$^2$) | — | — | 6.0 | — |
| Copolymer 6 (g/m$^2$) | — | — | | 6.0 |
| Surfactant (g/m$^2$) | 0.06 | 0.06 | 0.06 | 0.06 |
| Hardener (g/m$^2$) | 0.6 | 0.6 | 0.6 | 0.6 |

The obtained coated samples were printed on an IRIS 3024 printer using Ilfojet Galerie® inks, available from ILFORD AG, Fribourg, Switzerland.

The light fastness results after 20 kJ/m$^2$ Atlas exposure are listed in Table 3.

TABLE 3

| | Loss in % of initial density | | | |
|---|---|---|---|---|
| Sample No | Y | M | C | 1 K |
| 1 | 15 | 6 | 27 | 7 |
| 2 | 3 | 0 | 3 | 2 |
| 3 | 3 | 0 | 3 | 0 |
| 4 | 3 | 2 | 3 | 3 |

From the results in Table 3 it can be clearly seen that the vinyl amine/vinyl alcohol copolymers (samples 2 to 4) have a distinct beneficial effect on the light fastness of the printed colours when compared with receiving layers containing only gelatine (sample 1). The tricolour black (3K) obtained with this ink set shows a strong tendency to turn towards a green hue in control sample 1 after exposure due to an enhanced loss of magenta dye. Addition of the copolymers according to the invention (samples 2 to 4) is able to prevent this tendency almost completely as can easily be seen from the values given in Table 4 after 40 kJ/m$^2$ Atlas exposure.

TABLE 4

| | L*a*b* changes for 3K black | | |
|---|---|---|---|
| Sample No | L* | a* | b* |
| 1 | 6.3 | −7.4 | 7.4 |
| 2 | 0.4 | −0.9 | −0.1 |
| 3 | −0.1 | 0.8 | 0 |
| 4 | −0.1 | 0.6 | 0 |

EXAMPLE 4

Ink receiving layers were prepared as described above and coated onto clear polyester film. The pH of the coating solutions was adjusted to 6.0. The composition of the coated samples are listed in Table 5.

TABLE 5

| Sample No | 5 | 6 | 7 | 8 |
|---|---|---|---|---|
| Gelatine (g/m$^2$) | 8.2 | 8.2 | 4.5 | 8.2 |
| Lanthanum nitrate (g/m$^2$) | — | 0.3 | — | 0.3 |
| Copolymer 1 (g/m$^2$) | — | — | 3.7 | 3.7 |
| Surfactant (g/m$^2$) | 0.06 | 0.06 | 0.06 | 0.06 |
| Hardener (g/m$^2$) | 0.6 | 0.6 | 0.6 | 0.6 |

The light fastness results of the printed samples after 40 kJ/m$^2$ Atlas exposure are listed in Table 6.

TABLE 6

| | Loss in % of initial density | | | |
|---|---|---|---|---|
| Sample No | Y | M | C | 1K |
| 5 | 4 | 6 | 14 | 13 |
| 6 | 1 | 6 | 11 | 6 |
| 7 | 1 | 0 | 0 | 7 |
| 8 | 1 | 0 | 1 | 2 |

The ink receiving layers containing copolymer 1 of the invention (samples 7 and 8) clearly show improved light fastness of the dyes compared to layers a containing no copolymer (samples 5 and 6). Rare earth metal salts improve the light fastness of dyes in ink receiving layers as set forth in WO Patent Application 95/28285. This can be seen particularly well in coating samples 6 and 8 in the case of the black dye 1K. The combination of a lanthanum salt and a copolymer has a combined positive effect for the light fastness of the black dye.

Besides being beneficial for the light fastness the copolymers of the invention contribute substantially to the improvement of the water fastness of the printed sheets as can be seen by the results of the ink drop test listed in Table 7.

TABLE 7

| | Rundown at 45° | | | |
|---|---|---|---|---|
| Sample No | Y | M | C | 1 K |
| 5 | 3 | 3 | 3 | 3 |
| 6 | 2 | 3. | 2 | 3 |
| 7 | 0 | 0 | 0 | 2 |
| 8 | 0 | 0 | 0 | 2 |

EXAMPLE 5

Receiving layers were prepared as described above and coated onto clear polyester film. The layers have the composition as shown in Table 8. The pH of the coating solutions was adjusted to 6.4.

TABLE 8

| Sample No | 9 | 10 | 11 | 12 |
|---|---|---|---|---|
| Gelatine (g/m$^2$) | 8.0 | 7.0 | 6.0 | 5.0 |
| Copolymer 3 (g/m$^2$) | — | 1.0 | 2.0 | 3.0 |
| Surfactant (g/m$^2$) | 0.06 | 0.06 | 0.06 | 0.06 |
| Hardener (g/m$^2$) | 0.3 | 0.6 | 0.9 | 1.2 |

The samples were printed on an IRIS 3024 printer using Ilfojet Galerie® inks and exposed in the Atlas until 40 kJ/m$^2$ were reached. The results are shown in Table 9. The density loss of the black dye 1K is given separately for the three measured spectral channels (yellow, magenta, cyan).

TABLE 9

| | Loss in % of initial density | | | |
|---|---|---|---|---|
| Sample No | Y | M | C | 1K |
| 9 | 17 | 0 | 16 | 21/12/12 |
| 10 | 12 | 7 | 10 | 14/12/6 |
| 11 | 8 | 6 | 6 | 7/6/0 |
| 12 | 0 | 0 | 6 | 6/6/1 |

Increasing amounts of copolymer 3 clearly improve the light fastness of the dyes in the layers. The tricolour black (mixture of the yellow, magenta and cyan dye) with this ink set shows a strong tendency to turn towards a green hue during exposure in the control sample 8 due to an enhanced loss of magenta dye. Addition of copolymer 3 according to the invention in increasing amounts prevents this tendency almost completely, as sample 9 is only slightly greenish and samples 11 and 12 show a neutral hue after exposure.

The same receiving sheets were printed on a Canon 600 printer using proprietary Canon inks. Light fastness results after Atlas exposure to 40 kJ/m$^2$ are shown in Table 10.

TABLE 10

| | Loss in % of initial density | | | | |
|---|---|---|---|---|---|
| Sample No | Y | M | C | 1 K | 3K |
| 9 | 24 | 21 | 16 | 27/13/13 | 27/13/13 |
| 10 | 14 | 10 | 7 | 14/14/14 | 21/7/7 |
| 11 | 8 | 3 | 7 | 14/7/7 | 8/7/7 |
| 12 | 3 | 3 | 0 | 7/7/7 | 0/7/0 |

The stability improvement is also seen with the dyes used in the Canon 600 inks demonstrating clearly that the improvement in light fastness is due to the receiving layers and not due to the particular set of inks used.

The same materials were printed on a Hewlett Packard 560 printer using original HP inks and exposed in the Atlas until 20 kJ/m$^2$ were reached. The light fastness results after exposure are shown in Table 11.

TABLE 11

| | Loss in % of initial density | | |
|---|---|---|---|
| Sample No | Y | M | C |
| 9 | 27 | 71 | 81 |
| 10 | 25 | 58 | 75 |
| 11 | 8 | 49 | 71 |
| 12 | 0 | 42 | 69 |

This example clearly shows that, even with dyes of inherent poor stability towards the influence of light, copolymers according to the invention have a considerable stabilising effect on the light fastness of these dyes.

EXAMPLE 6

Receiving sheets with the composition as shown in Table 12 on clear polyester film were prepared according to the procedure described above. The pH of the coating solutions was adjusted to 6.4. The carboxymethyl cellulose used was Blanose®, type 7L1C1, available from Hercules-Aqualon France, Alizay, France.

TABLE 12

| Sample No | 13 | 14 | 15 | 16 | 17 |
|---|---|---|---|---|---|
| Gelatine (g/m$^2$) | 1.3 | 1.3 | 1.3 | — | — |
| Copolymer 1 (g/m$^2$) | — | 1.3 | 2.6 | 2.6 | 3.9 |
| Carboxymethyl cellulose (g/m$^2$) | 3.9 | 2.6 | 1.3 | 2.6 | 1.3 |
| Surfactant (g/m$^2$) | 0.1 | 0.1 | 0.1 | 0.1 | 0.1 |
| Hardener (g/m$^2$) | 0.02 | 0.02 | 0.02 | 0.02 | 0.02 |

The material was printed on an Iris 3047 printer with Ilfojet Galerie® inks and exposed in the Atlas to 40 kJ/m$^2$. Light fastness results are shown in Table 13.

TABLE 13

| | Loss in % of initial density | | | | |
|---|---|---|---|---|---|
| Sample No | Y | M | C | K | 3K |
| 13 | 19 | 14 | 10 | 15/12/12 | 6/22/5 |
| 14 | 10 | 0 | 6 | 14/12/6 | 6/6/5 |
| 15 | 10 | 0 | 6 | 21/13/13 | 0/6/5 |
| 16 | 4 | 0 | 3 | 7/6/6 | 0/5/0 |
| 17 | 4 | 0 | 6 | 7/0/0 | 6/0/0 |

Copolymers according to the invention are able to increase the light fastness of the dyes in the layers in quite different environments. The effect is seen together with binders or with the copolymer-on its own as is particularly evident in samples 16 and 17. As can be seen from the values for 3K there is again little or no tendency of a green shift in the presence of the copolymer.

EXAMPLE 7

The receiving layers described in Table 14 were prepared on a fine arts water colour paper obtained from a local drawing supply store. Saponin was used as surfactant. Polyvinyl alcohol of MW 50,000 to 70,000, available from Hoechst AG, Frankfurt am Main, Germany, was used.

TABLE 14

| Sample No. | 18 | 19 | 20 | 21 |
|---|---|---|---|---|
| Gelatine (g/m$^2$) | 2.88 | — | 1.44 | — |
| Polyvinyl alcohol (g/m$^2$) | — | — | — | 2.88 |
| Copolymer 3 (g/m$^2$) | — | 2.88 | 1.44 | — |
| Surfactant (g/m$^2$) | 0.06 | 0.06 | 0.06 | 0.06 |
| Hardener (g/m$^2$) | 0.014 | 0.032 | 0.032 | 0.014 |

The material obtained according to Table 14 was printed with Ilfojet Galerie® inks and exposed to 40 kJ/m$^2$ in the Atlas. Light fastness results obtained are given in Table 15.

TABLE 15

| | Loss in % of initial density | | | |
|---|---|---|---|---|
| Sample No | Y | M | C | 1 K |
| 18 | 4 | 3 | 5 | 7 |
| 19 | 0 | 1 | 1 | 3 |
| 20 | 1 | 2 | 0 | 2 |
| 21 | 8 | 9 | 5 | 13 |

As can be seen from these results the copolymer 3 of the invention is also able to increase the light fastness of the dyes in the printed image on specialty paper (samples 18 to 20) when compared to paper which was coated under identical conditions using polyvinyl alcohol only (sample 21).

EXAMPLE 8

Receiving layers coated according to Table 16 onto clear polyester film were prepared. The pH of the coating solutions was adjusted to 6.5. Saponin was used as surfactant.

TABLE 16

| Sample No | 22 | 23 | 24 | 25 | 26 |
|---|---|---|---|---|---|
| Gelatine (g/m$^2$) | 8.0 | 5.33 | 4.0 | 2.67 | — |
| Copolymer 3 (g/m$^2$) | — | 2.67 | 4.0 | 5.33 | 8.0 |
| Surfactant (g/m$^2$) | 0.1 | 0.1 | 0.1 | 0.1 | 0.1 |
| Hardener (g/m$^2$) | 0.02 | 0.04 | 0.06 | 0.08 | 0.08 |

The water uptake of the layers was adjusted to similar values (by varying the hardener quantity) despite the different ratios of copolymer to binder. This is important in order to have similar ink uptake during printing.

The above receiving layers were printed on a Hewlett-Packard 660 printer with original HP inks. The loss in density was measured after 40 kJ/m$^2$ Atlas exposure. Light fastness results are reported in Table 17.

TABLE 17

| | Loss in % of initial density | | |
|---|---|---|---|
| Sample No | Y | M | C |
| 22 | 58 | 41 | 30 |
| 23 | 13 | 27 | 18 |
| 24 | 3 | 22 | 13 |
| 25 | 1 | 21 | 14 |
| 26 | 0 | 15 | 10 |

The results in Table 17 clearly show that the light fastness of the dyes is a function of the amount of copolymer added. As can be seen the density losses tend to converge to the values achieved with the copolymer alone (samples 23 to 25 vs sample 26).

EXAMPLE 9

Receiving layers according to Table 18 were prepared on clear polyester film. The pH of the coating solutions was adjusted to 6.5. Blanose® type 7L1C1 was used as carboxymethyl cellulose.

TABLE 18

| Sample No | 27 | 28 | 29 | 30 | 31 |
|---|---|---|---|---|---|
| Gelatine (g/m$^2$) | 1.3 | 1.3 | 1.3 | — | — |
| Carboxymethyl cellulose (g/m$^2$) | 3.9 | 2.6 | 1.3 | 2.6 | 1.3 |
| Copolymer 3 (g/m$^2$) | — | 1.3 | 2.6 | 2.6 | 3.9 |
| Surfactant (g/m$^2$) | 0.1 | 0.1 | 0.1 | 0.1 | 0.1 |
| Hardener (g/m$^2$) | 0.02 | 0.02 | 0.02 | 0.02 | 0.02 |

The samples were printed on an IRIS Printer using Ilfojet Galerie® inks and exposed to 40 kJ/m$^2$ in the Atlas. Light fastness results are reported in Table 19.

TABLE 19

| Sample No | Loss in % of initial density | | | | |
|---|---|---|---|---|---|
| | Y | M | C | K | 3K |
| 27 | 19 | 14 | 10 | 15/12/12 | 6/22/5 |
| 28 | 10 | 2 | 6 | 14/13/6 | 0/6/5 |
| 29 | 10 | 1 | 6 | 12/13/6 | 0/6/5 |
| 30 | 5 | 1 | 3 | 7/6/6 | 0/0/0 |
| 31 | 4 | 0 | 4 | 7/0/0 | 6/0/0 |

Visual inspection as well as the evaluation of the values for the density losses in the three colour black (3K) show that in the case of coating 27 a severe shift towards greenish blacks occurred by a preferential loss of magenta. This is not the case for the samples containing copolymer 3 as can clearly be seen in coatings 28 to 31, where a balanced loss of all three colours occurred. From the results presented in Table 19 it becomes obvious that a considerable improvement in light stability can be achieved by the addition of the copolymers of the invention together with other binders at equal layer thickness.

EXAMPLE 10

Receiving layers according to Table 20 were coated onto clear polyester film. The pH of the coating solutions was adjusted to 5.5. The acrylic copolymer DP-6066, available from Allied Colloids Ltd,. Bradford, England, was used.

TABLE 20

| Example No. | 32 | 33 | 34 | 35 | 36 | 37 |
|---|---|---|---|---|---|---|
| Gelatine ($g/m^2$) | 2.7 | 2.7 | 2.7 | 2.7 | 2.7 | 2.7 |
| Copolymer 3 ($g/m^2$) | — | 0.9 | 1.8 | 2.7 | 4.5 | 6.3 |
| Acrylic copolymer ($g/m^2$) | 6.3 | 5.4 | 4.5 | 2.7 | 1.8 | — |
| Glycerol ($g/m^2$) | 0.09 | 0.09 | 0.09 | 0.09 | 0.09 | 0.09 |

The samples were printed on a LaserMaster® wide format printer using the original LaserMaster inks. After 40 $kJ/m^2$ exposure in the Atlas the dye losses reported in Table 21 were obtained.

TABLE 21

| Sample No | Loss in % of initial density | | | |
|---|---|---|---|---|
| | Y | M | C | 1 K |
| 32 | 44 | 52 | 3 | 61/38/23 |
| 33 | 33 | 47 | 5 | 41/28/19 |
| 34 | 23 | 44 | 0 | 33/20/9 |
| 35 | 8 | 45 | 1 | 29/19/9 |
| 36 | 2 | 40 | 1 | 20/12/6 |
| 37 | 2 | 30 | 1 | 14/6/0 |

It can be seen from the results in Table 21 that the improvement of the light fastness of the dyes in the printed image is clearly a function of the amount of vinyl amine/vinyl alcohol copolymer added to the layers.

When the above samples were printed on a Canon 600 printer with original inks the light fastness results after an Atlas exposure to 40 $kJ/m^2$ of Table 22 were obtained.

TABLE 22

| Sample No | Loss in % of initial density | | | |
|---|---|---|---|---|
| | Y | M | C | 1K |
| 32 | 30 | 45 | 4 | 17/7/7 |
| 33 | 25 | 29 | 4 | 14/13/6 |
| 34 | 28 | 21 | 3 | 20/13/12 |
| 35 | 22 | 16 | 6 | 19/12/12 |
| 36 | 2 | 16 | 12 | 9/5/5 |
| 37 | 3 | 7 | 4 | 7/0/0 |

The effect of the copolymers of the invention on the light fastness is again clearly visible. It also becomes clear that the effect is not restricted to a particular set of inks but is obtained with a wide variety of inks obtainable on the market.

EXAMPLE 11

A wood free paper was coated with a mixture of modified rosin sizing agent (modified rosin) and copolymer according to this invention as indicated in Table 23. Coatings with polyvinyl alcohol (MW 50,000 to 70,000) or polyvinylamine (MW 70,000, available from Air Products and Chemicals, Inc., Allentown, USA) instead of the copolymer of this invention were used as comparison. Sample 44 is an uncoated plain paper (comparison).

TABLE 23

| Sample No. | 38 | 39 | 40 | 41 | 42 | 43 |
|---|---|---|---|---|---|---|
| Polyvinyl alcohol ($g/m^2$) | 2.0 | — | — | — | — | 1.0 |
| Polyvinyl amine ($g/m^2$) | — | — | — | 2.0 | — | 1.0 |
| Copolymer 3 ($g/m^2$) | — | — | 2.0 | — | — | — |
| Copolymer 4 ($g/m^2$) | — | — | — | — | 2.0 | — |
| Copolymer 5 ($g/m^2$) | — | 2.0 | — | — | — | — |
| Modified rosin ($g/m^2$) | 0.2 | 0.2 | 0.2 | 0.2 | 0.2 | 0.2 |

The different coatings were printed on an IRIS printer using Ilfojet Galerie® inks and exposed in the Atlas to 40 $kJ/m^2$. Light fastness results are shown in Table 24.

TABLE 24

| Sample No | Loss in % of initial density | | | |
|---|---|---|---|---|
| | Y | M | C | K |
| 38 | 5 | 6 | 6 | 3/5/11 |
| 39 | 3 | 2 | 3 | 3/2/0 |
| 40 | 3 | 0 | 3 | 5/2/0 |
| 41 | 52 | 52 | 6 | 17/11/2 |
| 42 | 4 | 1 | 2 | 3/4/4 |
| 43 | 5 | 1 | 3 | 3/3/3 |
| 44 | 5 | 8 | 5 | 5/5/6 |

From the above values for the density losses it can be clearly seen that the copolymers of the invention have an obvious beneficial effect on the light fastness of the dyes in printed images also on plain paper (samples 39, 40, 42, 43). The benefit of the claimed copolymer becomes again quite evident when compared with sample 38 containing only polyvinyl alcohol or with sample 44 (plain paper). Sample 41 containing polyvinylamine shows considerably increased density losses.

EXAMPLE 12

Matte coated papers were prepared by coating plain paper base stock with coating slurries as given in Table 25. A styrene/acrylic acid sizing agent was used.

TABLE 25

| Sample No | 45 | 46 |
|---|---|---|
| Precipitated silica ($g/m^2$) | 0.875 | 0.875 |
| Fumed silica ($g/m^2$) | 0.375 | 0.375 |
| Copolymer 3 ($g/m^2$) | 0.625 | — |
| Polyvinyl alcohol ($g/m^2$) | — | 0.625 |
| Sizing agent ($g/m^2$) | 0.125 | 0.125 |

The different coatings were printed on an IRIS printer using Ilfojet Galerie® inks and exposed in the Atlas to 40 $kJ/m^2$. Light fastness results are shown in Table 26.

TABLE 26

| | Loss in % of initial density | | | |
|---|---|---|---|---|
| Sample No | Y | M | C | K |
| 45 | 0 | 1 | 2 | 10/7/3 |
| 46 | 13 | 25 | 43 | 50/42/36 |

It can be seen from the above results that the claimed copolymer 3 efficiently protects the dyes of the printed image against deterioration by light. While sample 45 with the copolymer according to the invention is practically intact after exposure, the comparative sample 46 is destroyed in such a way as to have lost completely its value.

The invention claimed is:

1. A recording sheet for ink jet printing comprising a support coated with at least one layer receptive for aqueous inks; wherein said layer contains:

(a) at least one copolymer of the general structure:

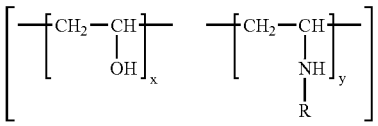

where

R=alkyl with 1–6 carbon atoms x+y=1 y=0.05–0.2 x=0.8–0.95; and (b) a binder of mixture of binders;

(c) wherein said layer provides the sheet with enhanced light fastness properties.

2. A recording sheet for ink jet printing according to claim 1 wherein said layer forms a film.

3. A recording sheet for ink jet printing according to claim 1 wherein said layer further contains a crosslinking agent.

4. A recording sheet according to claim 3 wherein said crosslinking agent is selected from the group consisting of triazine derivatives, epoxides, aldehydes, vinyl sulfones and carbamoyl derivatives.

5. A recording sheet according to claim 3 wherein said crosslinking agent is selected from the group consisting of triazine derivatives and carbamoyl derivatives.

6. A recording sheet according to claim 3 wherein said crosslinking agent is hydroxy-dichloro-1,3,5-triazine or 2-(4-dimethylcarbamoylpyridino)-ethane-sulfonic acid.

7. A recording sheet according to claim 1 wherein said binder or binders are selected from the group consisting of polyvinyl alcohol, gelatine, starch, carboxymethyl cellulose, hydroxyethyl cellulose, hydroxypropyl cellulose, hydroxymethyl cellulose, methoxyethyl cellulose, gum arabic, polyvinyl pyrrolidone, polyvinyl-methyl pyrrolidone and casein.

8. A recording sheet according to claim 1 wherein said binder or binders are selected from the group consisting of polymers or copolymers derived from acrylic acid and esters of acrylic acid.

9. A recording sheet according to claim 1 where R is $CH_3$.

10. A recording sheet for ink jet printing comprising a support coated with at least one layer receptive for aqueous inks; wherein said layer consists essentially of:

(a) at least one copolymer of the general structure:

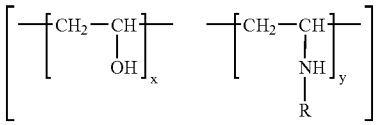

where R=H or alkyl with 1–6 carbon atoms x+y=1 y=0.05–0.2 x=0.8–0.95; and (b) a binder consisting of gelatin, and (c) wherein the quantity of said copolymer is between about 12 to 70 weight % of the combined amount of said copolymer and gelatin and said layer provides the sheet with enhanced light fastness properties.

11. A recording sheet according to claim 10 wherein said gelatin is selected from the group consisting of acid pigskin, limed bone gelatin, acid or base hydrolysed gelatins, phthaloylated, acetylated or carbamoylated gelatine; or gelatin that is derivatised with trimellitic acid.

12. A recording sheet according to claim 10 wherein said layer further contains a crosslinking agent.

13. A recording sheet according to claim 10 wherein said layer further contains fillers selected from the group consisting of kaolin, talcum, calcium or barium carbonates, silica, titanium oxide, chalk, bentonite, zeolite, aluminium silicate, calcium silicate, silicium oxide, colloidal silicium oxide or polymer beads.

14. A recording sheet according to claim 10 wherein said layer further contains water soluble metal salts selected from the group consisting of the salts of calcium, barium, magnesium or the salts of the rare earth metal series.

15. A recording sheet according to claim 10 wherein said layer further contains a surfactant selected from the group consisting of saponin, alkylene oxide derivatives, polyethylene glycol, polyethylene glycol/polypropylene glycol condensates, polyethylene glycol alkyl or alkylaryl ethers, polyethylene glycol esters, polyethylene glycol sorbitol esters, polyalkylene glycol alkylamine or amides or silicone/polyethylene oxide adducts, alkenylsuccinic acid polyglycerides or alkylphenol polyglycerides, aliphatic esters of polyhydric alcohols, alkyl esters of sucrose, urethanes or ethers, alky lcarboxylates, alkyl-sulfonates, alkylbenzenesulfonates, alkylnaphthalenesulfonates, alkyl sulphuric acid esters, alkyl phosphoric acid esters, N-acyl-N-alkyltaurines, sulfosuccinates, sulfoalkylpolyoxyethylene, alkyl phenyl ethers or polyoxyethylene alkyl phosphates, cationic surface agents, alkylamine salts, aliphatic or aromatic quaternary ammonium salts, pyridinium or imidazolium salts, or sulphonium salts containing an aliphatic or heterocyclic ring, or fluorinated or perfluorinated derivatives of the mentioned compounds.

* * * * *